US006065313A

United States Patent [19]

Huang

[11] Patent Number: 6,065,313

[45] Date of Patent: May 23, 2000

[54] SAFETY PRESS-TYPE ZIPPER LOCK

[76] Inventor: Chien-Yung Huang, No. 40, Jaw An Street, Taipei, Taiwan

[21] Appl. No.: 09/191,451

[22] Filed: Nov. 12, 1998

[51] Int. Cl.[7] ..... E05B 67/38

[52] U.S. Cl. ..... 70/68; 70/316; 70/317; 70/DIG. 44

[58] Field of Search ..... 70/68, 69, 312, 70/315, 317, DIG. 44, 316, 318, 319

[56] References Cited

U.S. PATENT DOCUMENTS

| | | | |
|---|---|---|---|
| 4,155,234 | 5/1979 | Bako | 70/70 |
| 4,771,617 | 9/1988 | Düeringer | 70/315 |
| 4,852,372 | 8/1989 | Ling | 70/312 |
| 4,854,139 | 8/1989 | Scelba | 70/68 |
| 5,092,149 | 3/1992 | Bartsch et al. | 70/317 |
| 5,136,864 | 8/1992 | Spiekermann et al. | 70/312 |
| 5,557,954 | 9/1996 | Ling | 70/312 |
| 5,689,979 | 11/1997 | Yu | 70/312 |
| 5,927,110 | 7/1999 | Yu | 70/316 |

*Primary Examiner*—Darnell M. Boucher
*Attorney, Agent, or Firm*—Pro-Techtor International Services

[57] ABSTRACT

A safety press-type zipper lock in which a lock casing is formed with two slots for placing therein tabs of a zipper slider. Each of a left and a right push buttons has a latch hook for locking with the tab. A bounding resilient plate is disposed in the slot for bouding the tab out of the slot. The numeral wheels serve to drive the notched wheel to rotate. The notched wheel serves to drive a sliding plate to shift within the lock casing. A numeral-changing button in a numeral-changing hole of the lock casing can be pressed by a sharp article, whereby a projection at one end of the numeral-changing button is engage with a protuberance of the sliding plate to lock the sliding plate for turning the numeral wheels to change the numerals. In the case that the tab fails to get into the proper position in the slot, the engaging block in the sliding plate is stopped by the left and right push buttons from moving, whereby the numeral wheels can be turned to drive the notched wheel to rotate and the notched wheel then shifts the sliding plate which compresses the compression spring. Under such circumstance, the notched wheel will be rotated along with the numeral wheels and the numerals will not change to avoid random code.

1 Claim, 9 Drawing Sheets

SAFETY PRESS-TYPE ZIPPER LOCK

BACKGROUND OF THE INVENTION

The present invention relates to a safety press-type zipper lock in which a compression spring is disposed in an engaging block. In the case that a user is unaware of that the tab H of the zipper is not located in a correct position in the slot of the lock casing and turns the numeral wheels, the numerals will not be changed to cause a random code.

FIGS. 1 and 2 show a conventional press-type zipper lock of a luggage case. When the numeral wheels B in the lock casing A are turned to the correct numerals, a user can push a push button C inward, making a lever at lower end of a tongue plate D compress a spring F. Two tabs H of the zipper slider G serve to press a pressing board I to compress a spring J to fit onto a projecting post K. When the push button C is released from the pushing force, the tongue plate D is able to lock the tabs H. At this time, the numeral wheels B can be randomly turned to lock the zipper lock. When it is desired to change the numerals, the lock device is arranged in an unlocking position with the push button C pushed inward. At this time, the lever E of the lower end of the tongue plate D stops the sliding plate L, disabling the notched wheel M from moving. At this time, the numeral wheels B can be turned to change the numerals. However, in case the tab D has an excess thickness and is not located at a correct position when fitted onto the projecting post K, the sliding plate L will be engaged with the lever E of the tongue plate D. Under such circumstance, in case the user is unaware of this and turns the numeral wheels B, a random code will be formed.

SUMMARY OF THE INVENTION

It is therefore a primary object of the present invention to provide a safety press-type zipper lock in which an engaging block is disposed in the sliding plate of the lock casing and a compression spring is disposed in the engaging block. In the case that the tabs of the zipper is not located in a correct position and clogged and a user is unaware of this and turns the numeral wheels, the numerals will not be changed to cause a random code.

It is a further object of the present invention to provide the above zipper lock in which when it is desired to change the numerals, this can be done only by means of pressing the numeral-changing button with a sharp article to lock a projection of the numeral-changing button with a protuberance of the sliding plate. At this time, the sliding plate cannot be moved, permitting a user to change the numerals.

The present invention can be best understood through the following description and accompanying drawings, wherein:

DETAILED DESCRIPTION OF THE PREFERRED EMBODIMENT

Figure 1:
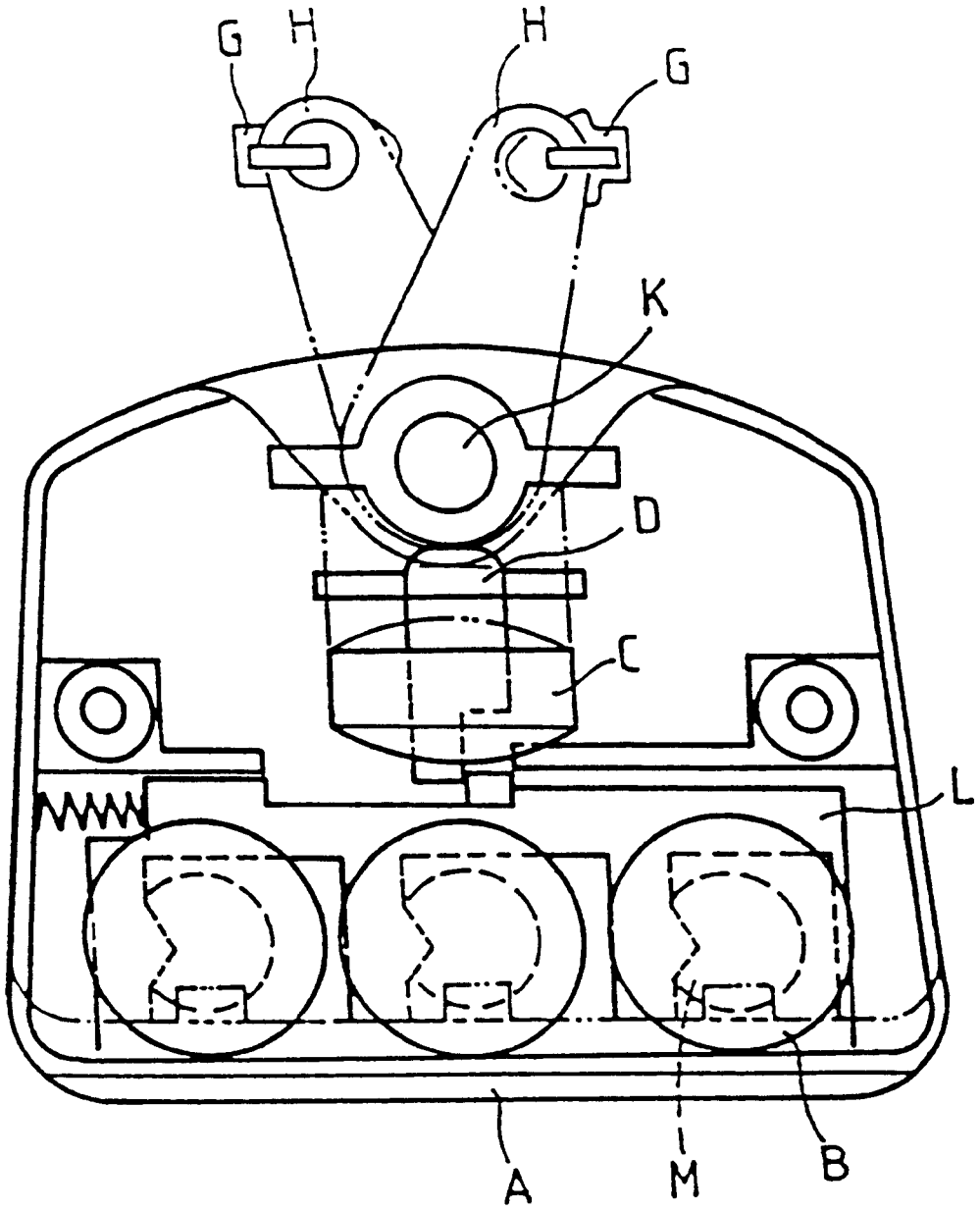
FIG. 1 is a sectional view of a conventional zipper lock.
Figure 2:
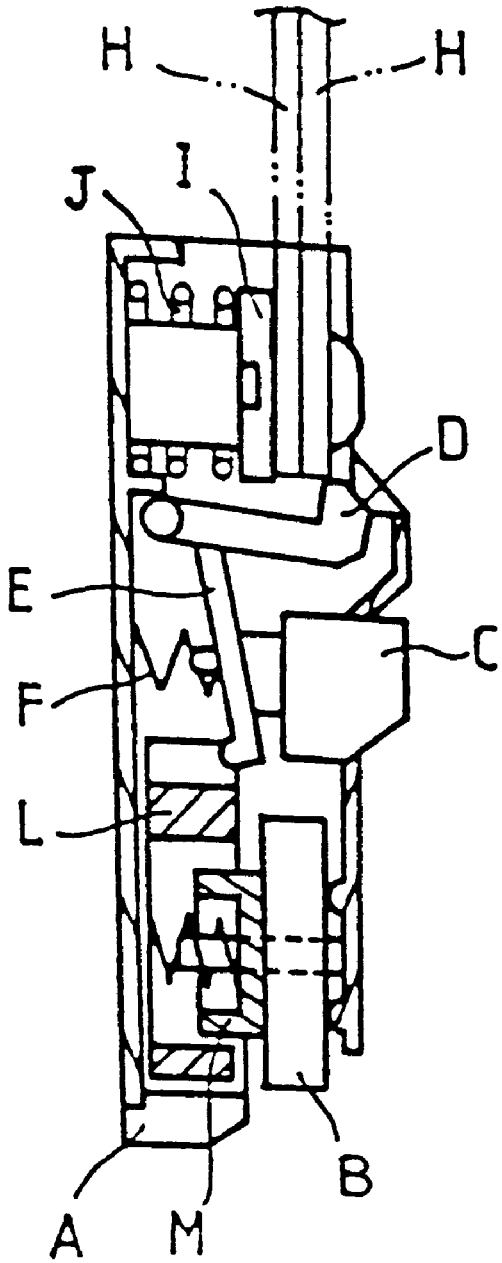
FIG. 2 is a side view of the conventional zipper lock.
Figure 3:
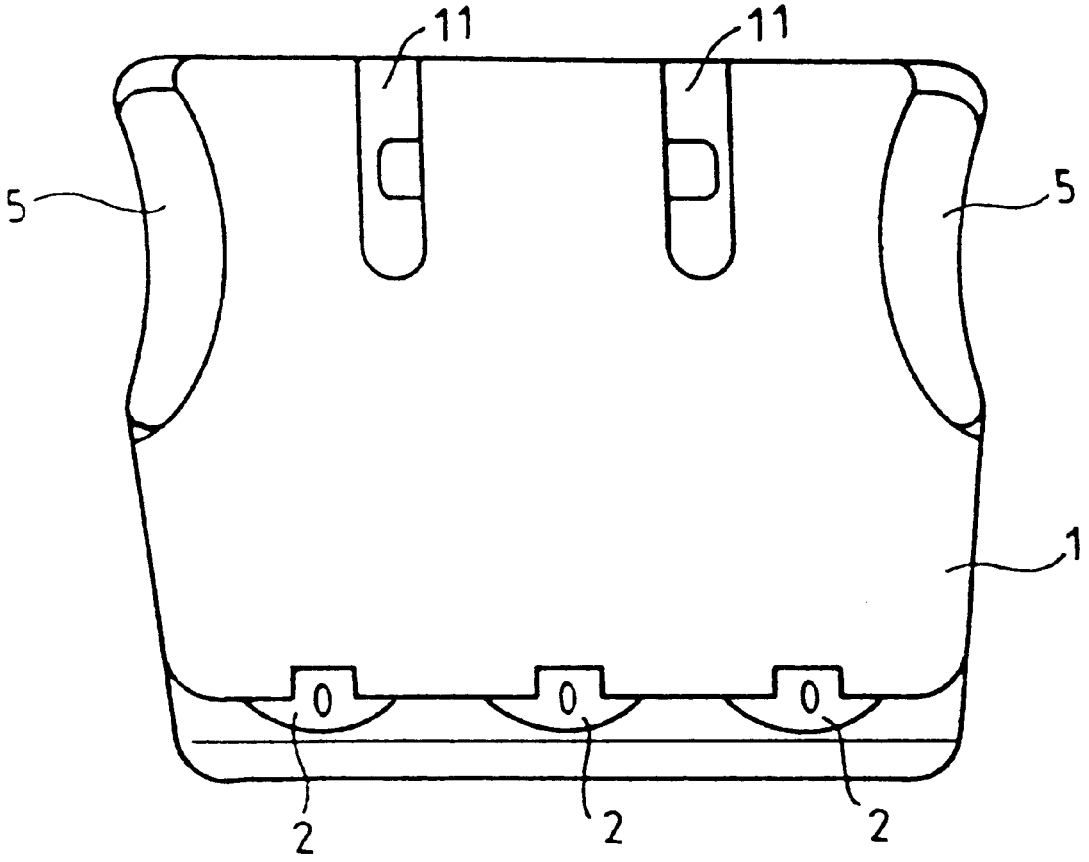
FIG. 3 is a top view of the present invention.
Figure 4:
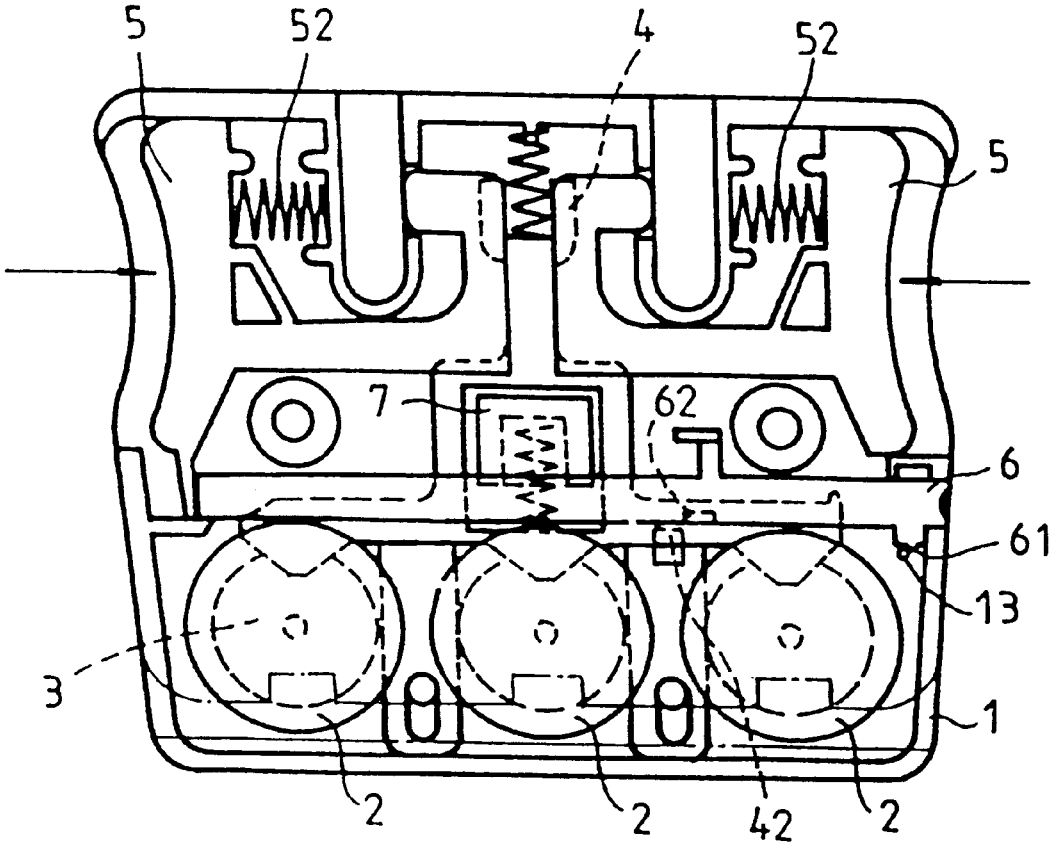
FIG. 4 is a sectional view of the present invention in an unlocked state.
Figure 5:
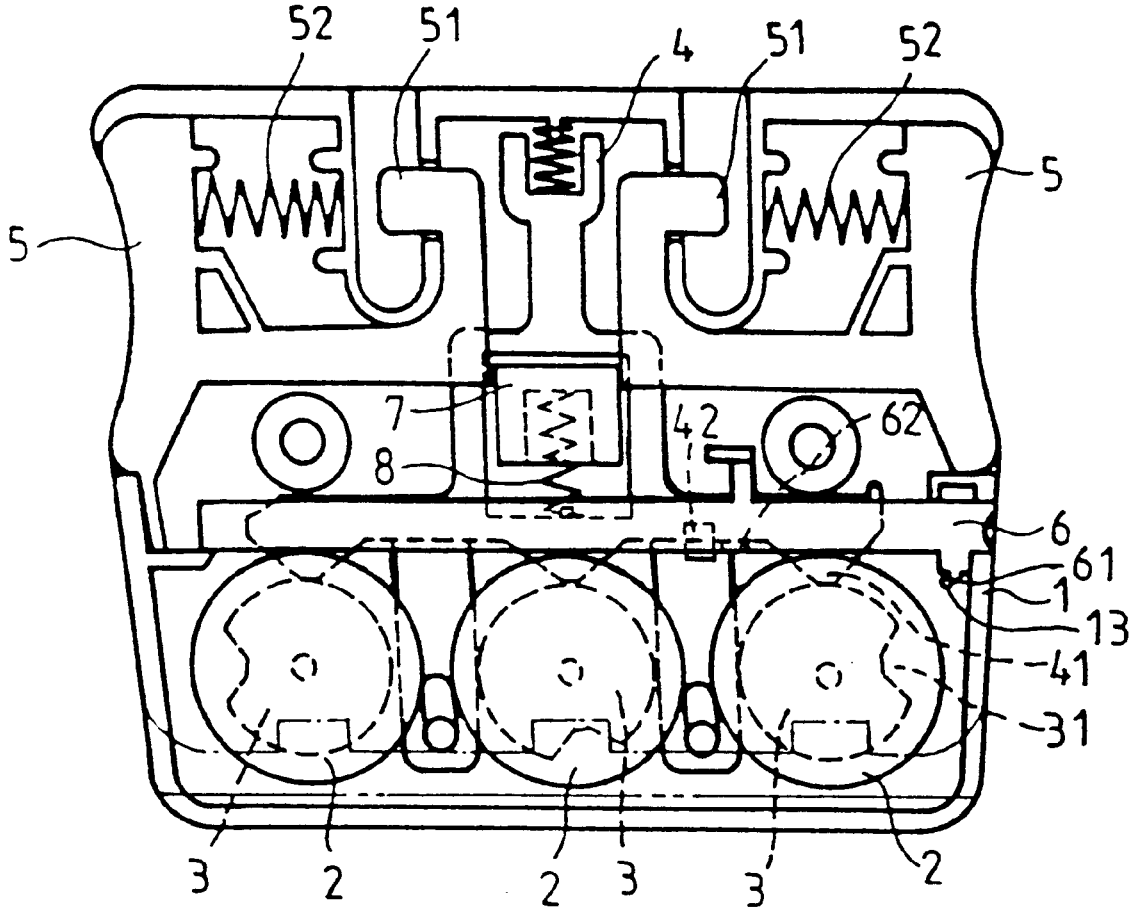
FIG. 5 is a sectional view of the present invention in a locked state.
Figure 6:
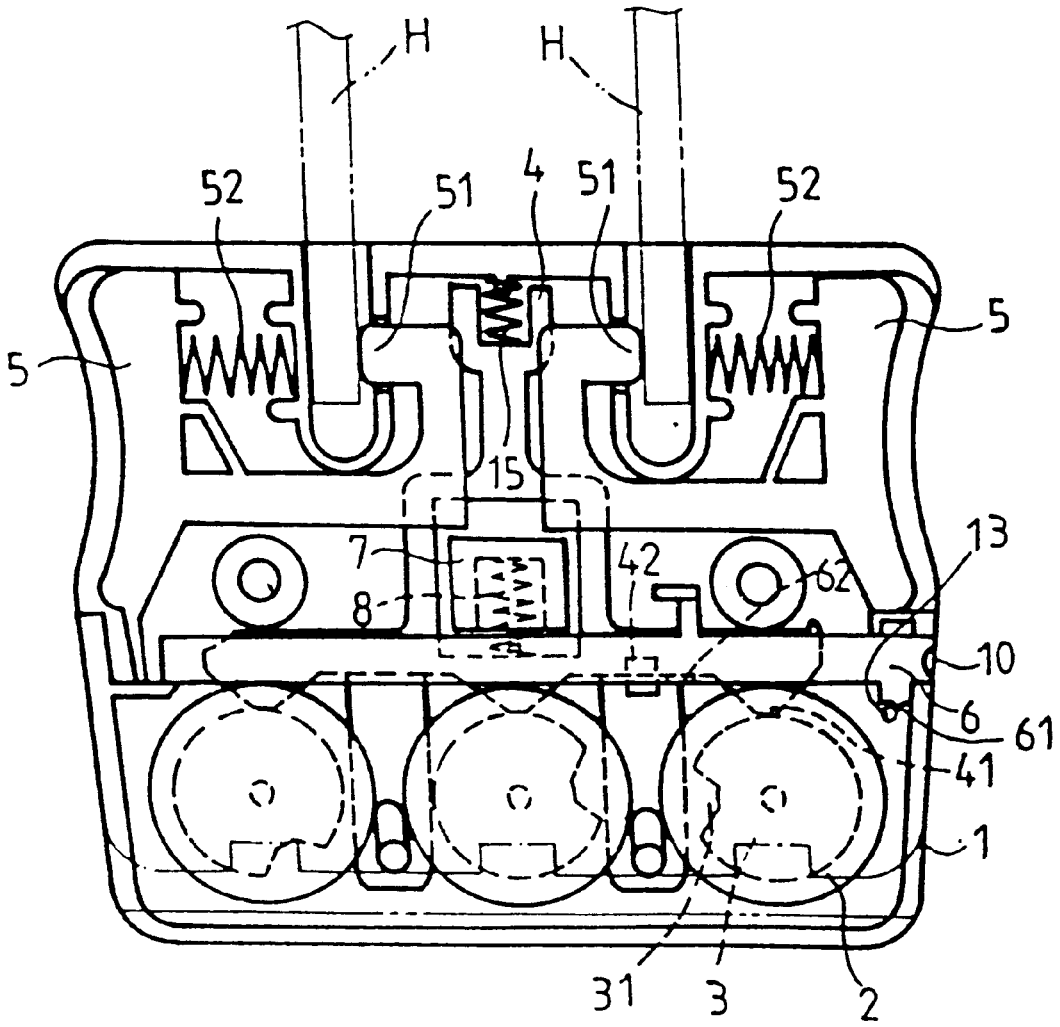
FIG. 6 is a sectional view of the present invention in a safety state.
Figure 7:
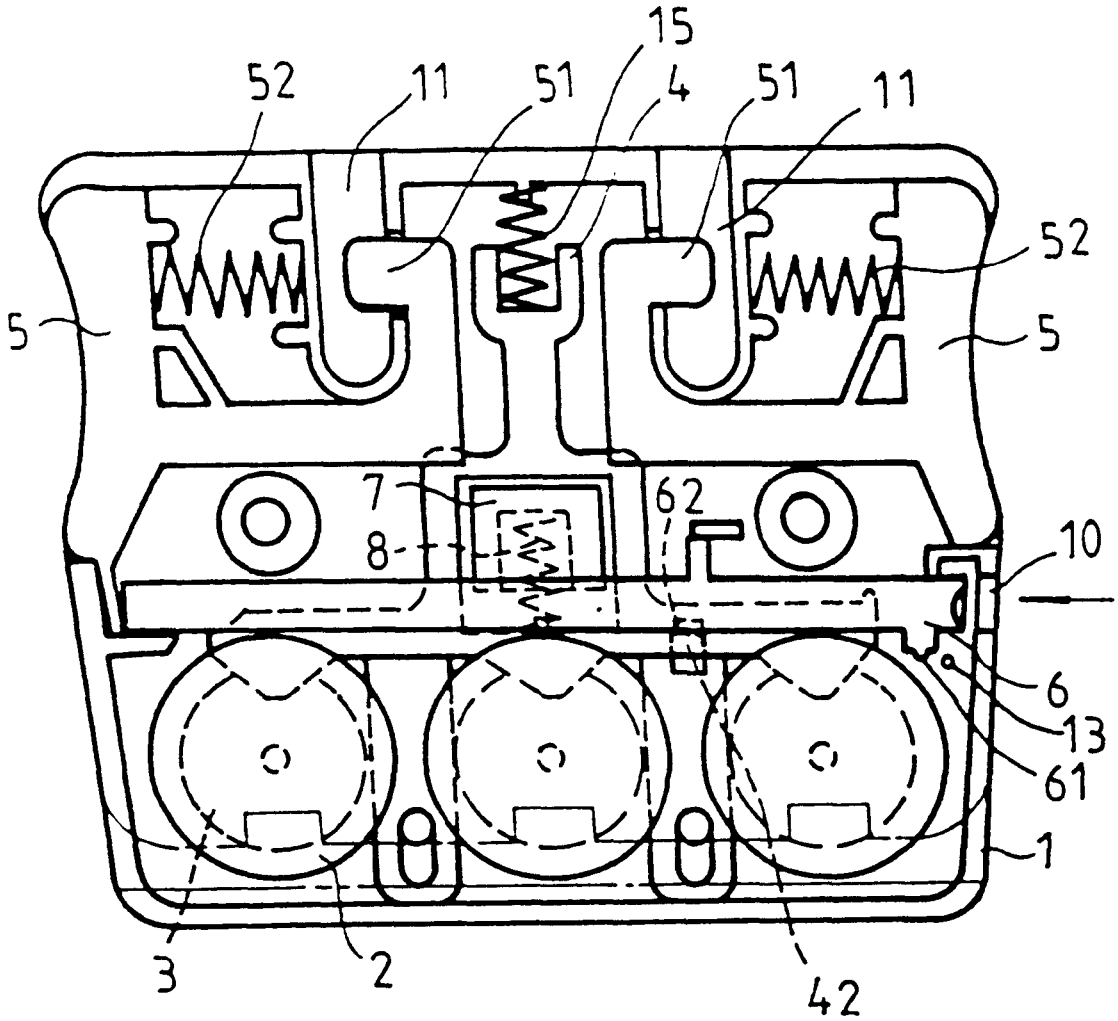
FIG. 7 is a sectional view of the present invention when changing the numerals.
Figure 8:
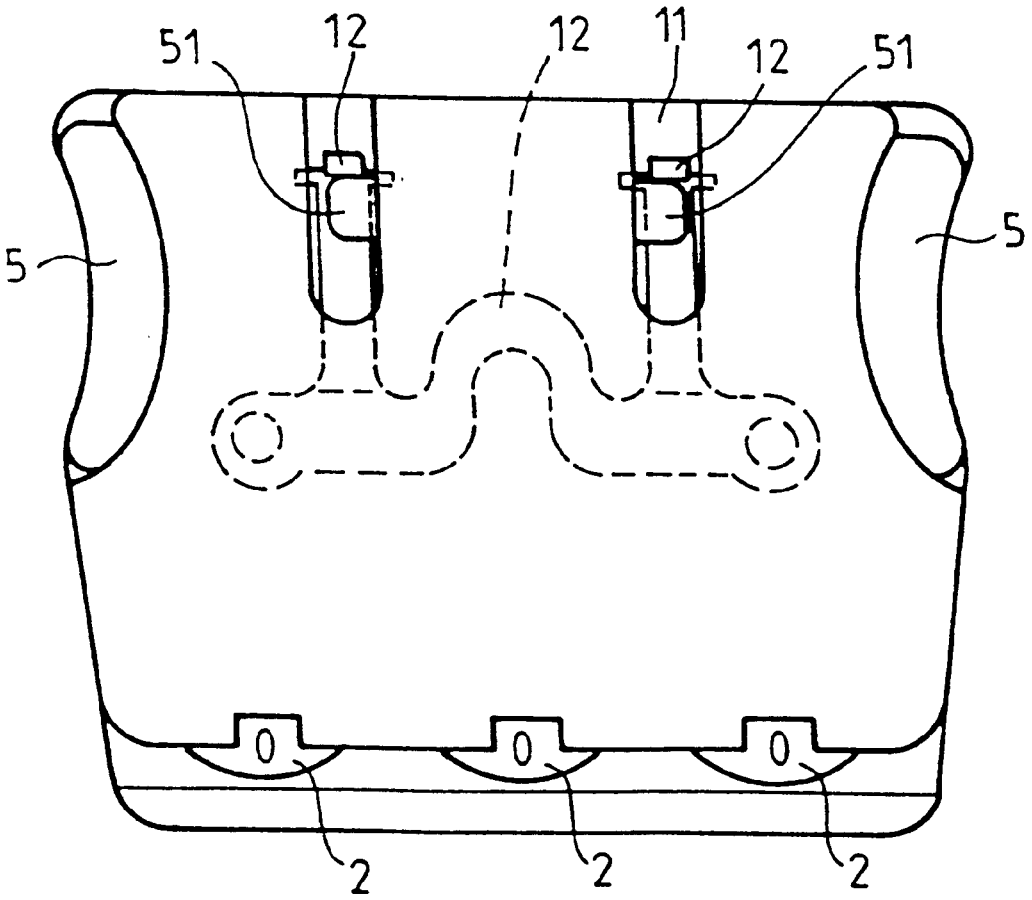
FIG. 8 shows the bounding resilient plate of the present invention.
Figure 9:
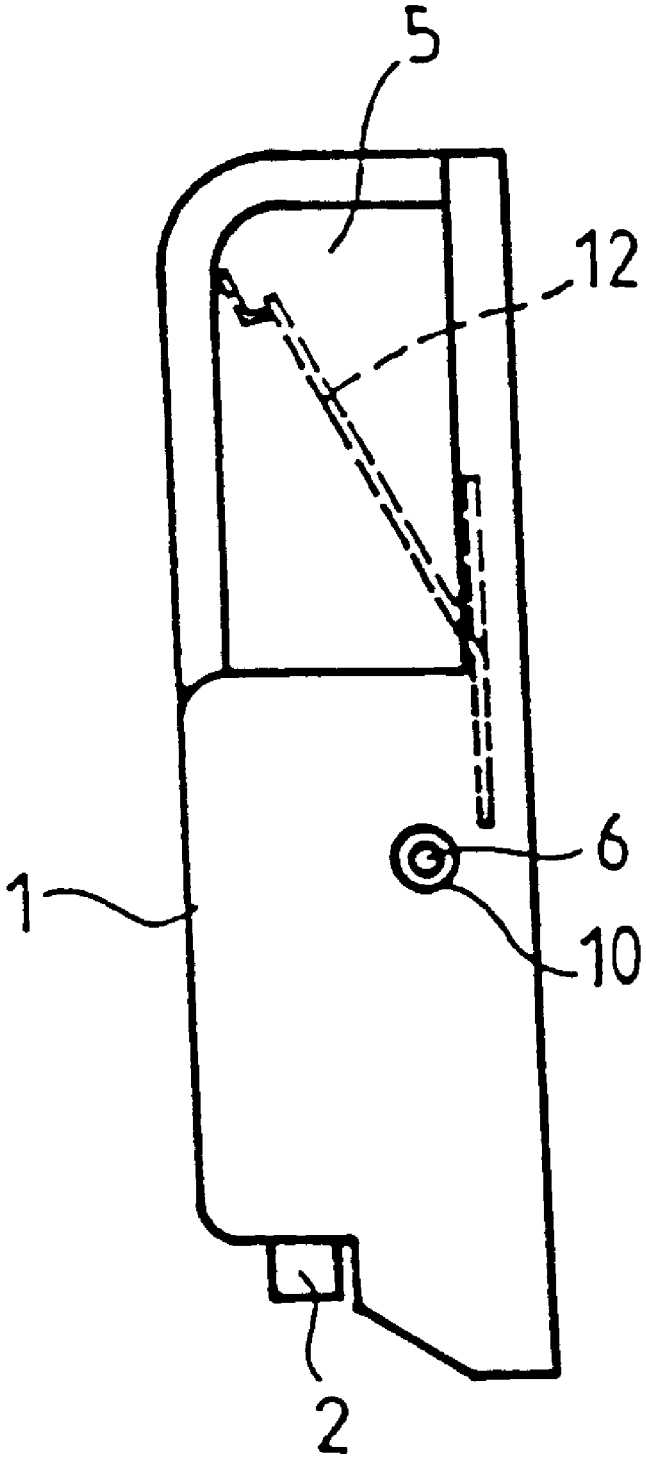
FIG. 9 is a side view showing the bounding resilient plate of the present invention.

Please refer to FIGS. 3 to 7. The present invention includes a lock casing 1, numeral wheels 2, notched wheels 3, a sliding plate 4, a left and a right push buttons 5, a numeral-changing button 6, an engaging block 7 and a compression spring 8. The lock casing 1 is formed with two slots 11 for placing therein the tabs H of the zipper slider of a luggage case. The push button 5 has a latch hook 51 for locking in a perforation of the tab H (as shown in FIG. 5). The bottom end of the slot 11 is disposed with a bounding resilient plate 12 (as shown in FIG. 8). When the tab H is positioned in the slot 11, the resilient plate 12 is pressed by the tab H. When the latch hook 51 of the push button 5 is separated from the perforation of the tab H, the resilient plate 12 serves to bound the tab H out of the slot 11.

The numeral wheel 2 serves to drive the notched wheel 3 to rotate. Except at a numeral-changing position, the notched wheel 3 is synchronized with the numeral wheel 2. The sliding plate 4 has a projection 41 for engaging in a notch 31 of the notched wheel 3. The notched wheel 3 serves to drive the sliding plate 4 to shift within the lock casing 1. The left and right push buttons 5 are respectively arranged on two sides of the lock casing 1. The push button 5 can be pressed to compress a spring 52.

The numeral-changing button 6 is positioned at one end of a numeral-changing hole 10 of the lock casing 1. A user can insert a sharp article (such as a pen) into the numeral-changing hole 10 to press the numeral-changing button 6, making a projection 62 at one end of the numeral-changing button 6 engaged with a protuberance 42 of the sliding plate 4 (as shown in FIG. 7). At this time, a locating protuberance 61 of the numeral-changing button 6 is shifted from a right side of a projecting post 13 of the lock casing to a left side thereof. Accordingly, the sliding plate 4 is locked and cannot be moved. Correspondingly, the notched wheel 3 is prevented from rotating. Under such circumstance, the user can turn the numeral wheels 2 to change the numerals. Thereafter, the numeral-changing button 6 can be restored to its home position by means of pressing the left push button 5 to the end.

Referring to FIG. 6, in the case that the tab H fails to get into the proper position in the slot 11 (that is, the latch hook 51 of the push button 5 is engaged with the tab H to lock the same), the push button 5 cannot be restored to its home position. At this time, the engaging block 7 in the sliding plate 4 is stopped by lower angles of the left and right push buttons 5 from moving. Under such circumstance, the numeral wheels 2 can be turned to drive the notched wheel 3 to rotate. The notched wheel 3 then shifts the sliding plate 4 which compresses the compression spring 8 in the engaging block 7. Therefore, the numerals will not change. (The conventional lock device lacks the compression measure so that the notched wheel cannot be moved and turning the numeral wheels will lead to random code.) Accordingly, the present invention is able to avoid random code. In the case that the user further turns the numeral wheels 2 to the correct unlocking numerals, the spring 15 at the top end of the lock casing 1 will push the sliding plate 4 downward and restore the same to its home position.

According to the above arrangements, in the case that a user is unaware of that the tab H of the zipper is not located in a correct position and turns the numeral wheels 2, the numerals will not be changed to cause a random code. When it is desired to change the numerals, this can be done only by means of pressing the numeral-changing button with a sharp article.

It is to be understood that the above description and drawings are only used for illustrating one embodiment of the present invention, not intended to limit the scope thereof. Any variation and derivation from the above description and drawings should be included in the scope of the present invention.

What is claimed is:

1. A safety press-type zipper lock comprising a lock casing, numeral wheels, notched wheels, a sliding plate, left and right push buttons, a numeral-changing button, an engaging block and a compression spring, wherein the lock casing is formed with two slots for placing therein tabs of a zipper slider, each push button having a latch hook for locking in a perforation of the tab, a bottom end of each of the slots being disposed with a resilient plate for keeping the tab out of the slot if the perforation of the tab is not aligned with the latch hook, the numeral wheel serving to drive the notched wheel to rotate, the notched wheel serving to drive the sliding plate to shift within the lock casing, the left and right push buttons being respectively arranged on two sides of the lock casing, the push button serving to compress a spring; wherein the numeral-changing button is positioned at one end of a numeral-changing hole of the lock casing, a projection at one end of the numeral-changing button being able to engage with a protuberance of the sliding plate, by means of using a sharp article to press the numeral-changing button, a locating protuberance of the numeral-changing button being shifted from right side of a projecting post of the lock casing to a left side thereof, whereby the sliding plate is locked and the notched wheel is prevented from rotating and the numeral wheels can be turned to change the numerals, the engaging block being positioned in the sliding plate with the compression spring extending into the engaging block, and wherein when the tab is not properly positioned in the slot, the engaging block is stopped by lower angles of the left and right push buttons from moving, whereby the numeral wheels can be turned to drive the notched wheel to rotate and the notched wheel then shifts the sliding plate which compresses the compression spring so that the notched wheel is rotated along with the numeral wheels.

* * * * *